US006133549A

United States Patent [19]

Shih et al.

[11] Patent Number: 6,133,549

[45] Date of Patent: Oct. 17, 2000

[54] HEAT TREATMENT FURNACE AND CONVEYOR WITH MULTI-CONVEYANCE

[76] Inventors: Chun-ming Shih, 5F, No.5, Lane 252, Sec. 6, Chung Shen N. Rd., Taipei, Taiwan; Yu-sen Lin, 4F,No.11, Alley 8,Lane 212,Chung Cheng Rd., Taipei, Taiwan; Pei-Ching Lin, 4F,No.11, Alley8,Lane 212, Chung Cheng Rd., Taipei, Taiwan

[21] Appl. No.: 09/353,601

[22] Filed: Jul. 14, 1999

[51] Int. Cl.[7] ..... F27B 9/06

[52] U.S. Cl. ..... 219/388; 432/121; 432/243; 34/167; 198/844.1

[58] Field of Search ..... 219/388; 432/121, 432/243, 246; 34/167, 168, 171, 178, 203, 205, 207; 198/844.1, 836.1

[56] References Cited

U.S. PATENT DOCUMENTS 1,520,187 12/1924 Lawson ..... 34/203

2,452,983 11/1948 Birdseye ..... 426/464

4,892,647 1/1990 Liddle et al. ..... 209/11

*Primary Examiner*—Teresa Walberg

*Assistant Examiner*—Shawntina S. Fuqua

*Attorney, Agent, or Firm*—Rosenberg, Klein & Lee

[57] ABSTRACT

A heat treatment furnace and conveyor with multi-conveyance, wherein the top of the furnace has a feeder and the bottom of which has a disposal. The inside of the furnace has a number of conveying units, each unit is in circular status lined up and move with the feeder at the top of the first pallet, and the end of each pallet is connected to the beginning of the next pallet, and the end of the last pallet is connected to the disposal. This reduces the width of the furnace and extend the length of conveying which enhances the heat treatment processing time. The furnace is also divided into several sections, as a heating section and a cooling section. The heating section is equipped with electric heating elements while the cooling section is not. The pallet belt is in a flat surface with some ribs to prevent objects from sticking or sliding off.

2 Claims, 6 Drawing Sheets

HEAT TREATMENT FURNACE AND CONVEYOR WITH MULTI-CONVEYANCE

FIELD OF THE INVENTION:

This invention relates to a heat treatment furnace and conveyor with multi-conveyance, and more particularly to an integral processing unit to control product quality.

BACKGROUND OF THE INVENTION

The current manufacturers of small sized springs are mostly processed by cold drawing to the desired size under a room temperature and then tempering to increase the elastic character. This is processed in a heat furnace, and the small springs are collected in a container after the heat treatment and kept in the room temperature to cool down the temperature of the springs. This therefore can be referred as a 'heat furnace'. The temperature of this 'heat furnace' can not be controlled which causes a poor quality product.

PRIOR ART

The conventional heat treatment furnaces for springs were in three different types:

(1) simple type;

The furnace is equipped with electric tubes, springs are conveyed into the furnace, and the end of the pallet has a disposal. The shortcomings of this type are the two hooks at respective ends of the spring may hooked the pallet and winded to the pallet that causes an over heating and affects the quality.

(2) harmonic vibration type;

As shown in FIG. 5, the furnace A with a sliding barrel A1 at the center portion having a disposal A11. The sliding barrel A1 has a feeder A2 at its front end, and a block A31 at the bottom. The sliding barrel A1 is slid on a guide rod A3. There is a push rod A42 of an output shaft A41 of a motor A4 extending and engaging with the block A31 and urged by a spring A5. Thus, by the urging force of the spring A5, the sliding barrel A1 will produce a harmonic movement and the material (springs) moves rearward. The shortcomings of this type are that the springs are light in weight, sometimes they can not move rearward as predict. And the springs remain in the furnace too long, especially, they roll in the sliding barrel A1, therefore, can not control the time for an accurate heating treatment.

(3) standing spiral vibrating type:

As shown in FIG. 6, the furnace B is a barrel type which spins in accordance with the guide rail B1 and a transmission C at the bottom of the furnace B. Upon the furnace spin, the materials fall on the guide rail B1 will be heated, however, the standing type makes the springs roll too fast which also causes uneven heat treatment.

Furthermore, the above-mentioned three furnaces do not have tempering capability, thus, after the heat treatment, the spring collected by the disposal still has the temperature which has to wait for the temperature cool down before packing. During this time, the heat may burn workers, accidentally.

SUMMARY OF THE INVENTION

It is the primary object of the present invention to provide a heat treatment furnace and conveyor with multi-conveyance which increases the conveyance length to improve the quality of the product without increase the size of the furnace It is another object of the present invention to provide a heat treatment furnace and conveyor with multi-conveyance which includes a cooling section to temper the product and has an integral production line.

It is still another object of the present invention to provide a heat treatment furnace and conveyor with multi-conveyance which adopts a flat conveyance so that raw materials may be conveyed in a steady and smooth speed to insure an accurate heating treatment.

It is a further object of the present invention to provide a heat treatment furnace and conveyor with multi-conveyance which has ribs along the pallet belt which prevent raw materials from dropping into the furnace.

DETAILED DESCRIPTION OF THE PREFERRED EMBODIMENT

Figure 1:
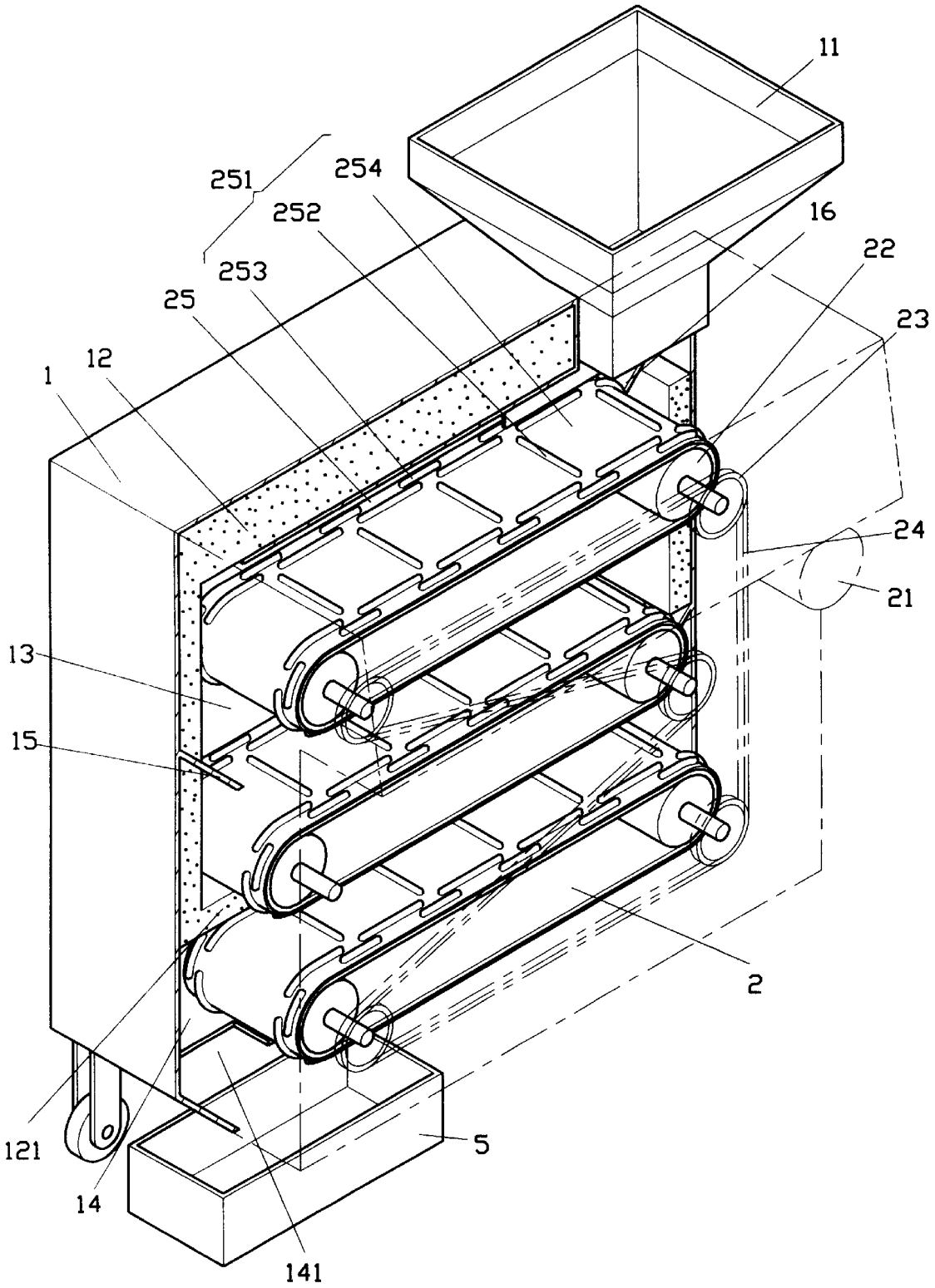
FIG. 1 is a perspective view of the present invention.
Figure 2:
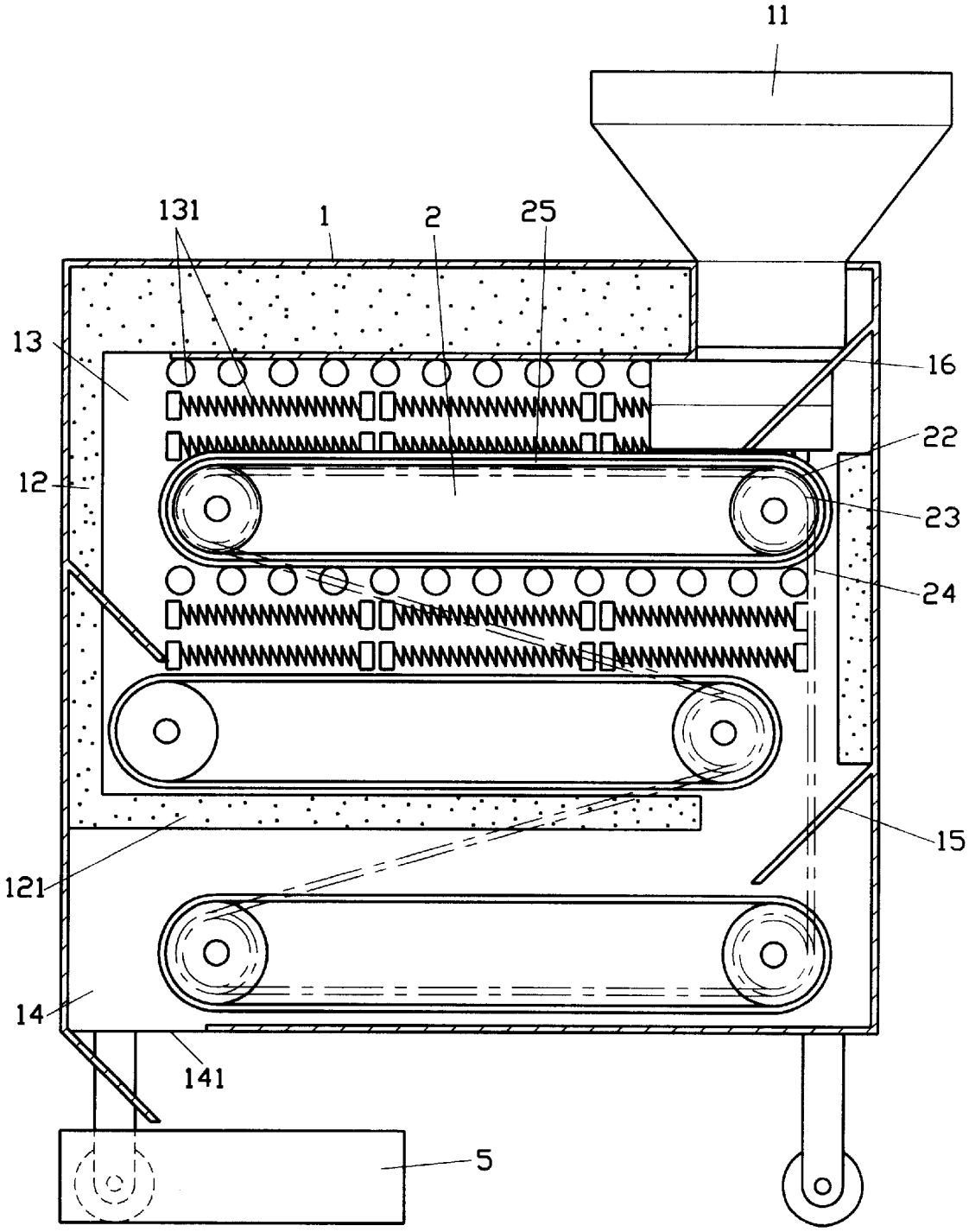
FIG. 2 is a cross sectional view of the present invention.

The furnace 1 of the present invention comprises pallet units 2 and a number of eat isolated material 12.

The furnace 1 has a feeder 11 at top portion and the heat isolated material 12 at the inner wall that partitioned into a heating section 13 and a cooling section 14 which is isolated by an isolated material 121. The heating section 13 is equipped with plural electric heating devices 131 on the inner wall, while the cooling section 14 is formed with a disposal 141 at its bottom end thereof. The furnace 1 is formed with a few pallet units 2 in a parallel arrangement. Each unit 2 has a motor 21 drives a roller 22 which then drives a chain wheel 23, and meshes with a chain 24 to each other to drive the other pallet units 2 simultaneously. The roller 22 winds with a pallet belt 25 forming a closed circulation. Each pallet belt 25 has a loading section 251. Each pallet unit 2 is identical but in opposite direction secured in the heating section 13 and the cooling section 14 of the furnace 1, and is arranged on one after the other [i.e. the second pallet unit 2 has its starting end under the end of the first pallet unit 2]. The first pallet unit 2 has its starting end in connection with the feeder 11, and the last pallet units 2 has its end in connection with the disposal 141. The end of each pallet unit 2 is a guide board 15 corresponding thereat and a support 16 corresponding to the end portion of the feeder 11 to guide raw materials fall on the accurate position. The pallet belt 25 has a number of stopper strips 252 equally lined up and ribs 253 on respective sides thereof. The pallet belt 25 is divided into a number of sections 254.

The furnace 1 is equipped with electric heating devices 131 in the heating section 13 which also comprises isolating materials 12, 121 preventing high temperature from transforming to the surface of the furnace 1. The cooling section 14 has no electric heating device, and is therefore the best place for tempering.

In operation, feed raw materials (for instance little springs) through the feeder 11 into the furnace 1, the materials will be dropped to the pallet belt 25 and will be kept at place by the guide board 15 and the support 16 confinement. This will make the raw materials in a good heating treatment. When the pallet belt 25 is driven by the motor 21 to activate the roller 22 and convey the materials to the heating treatment in the heating section 13, whereas the material will gradually go through each pallet 25 and at the end drop onto the next pallet belt 25, until it reaches to the cooling section 14 which in this example is set at the third pallet belt 25. The cooling section 14 is covered by the isolating material 121 which isolates the heat from the heating section 13. Upon reaching to the end of the cooling section 14, the material will be dropped from the disposal 141 and into a box 5.

The above-mentioned furnace 1 is equipped with an isolated material 121 between the heating section 13 and the cooling section 14, without this isolating material 121, the cooling section 14 is apart from the heating section 13, will still maintain a lower temperature compares with the high temperature of the heating section 13, thus, the cooling section 14 is still able to provide a tempering situation.

Figure 3:
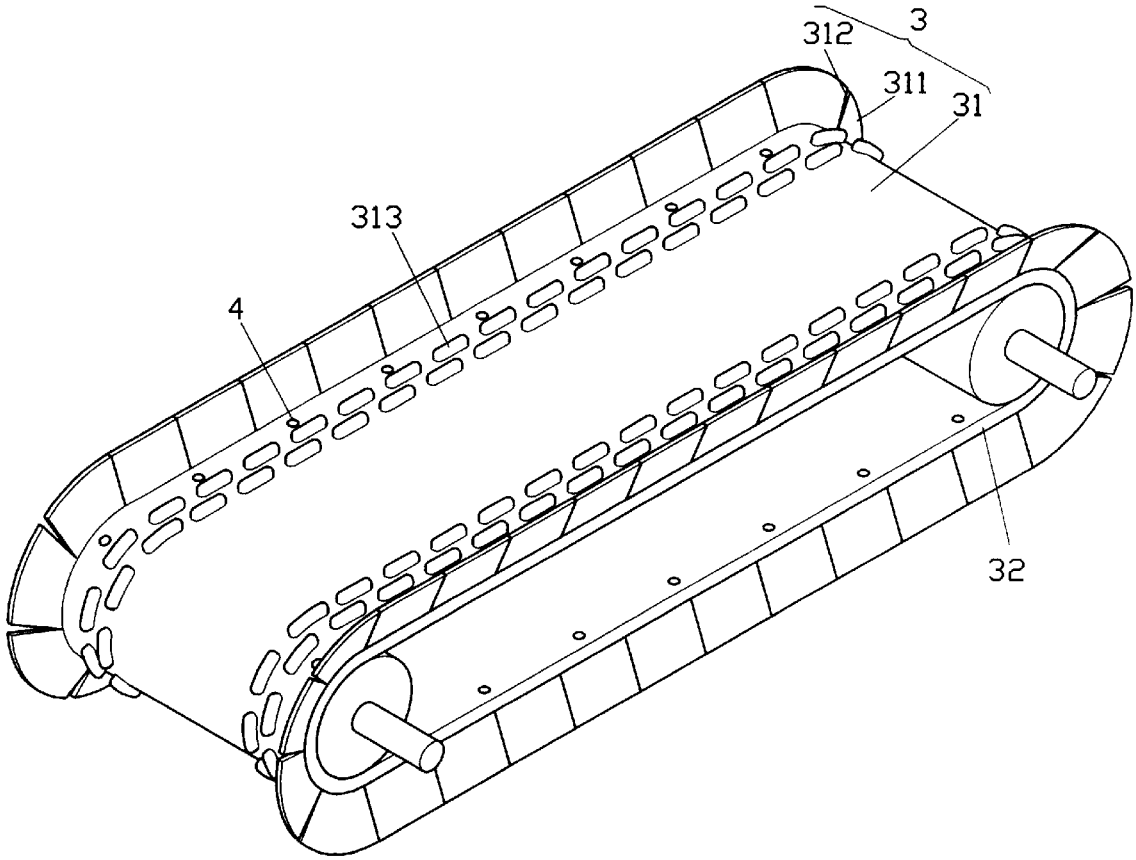
FIG. 3 is a perspective view of a pallet belt of the present invention.
Figure 4:
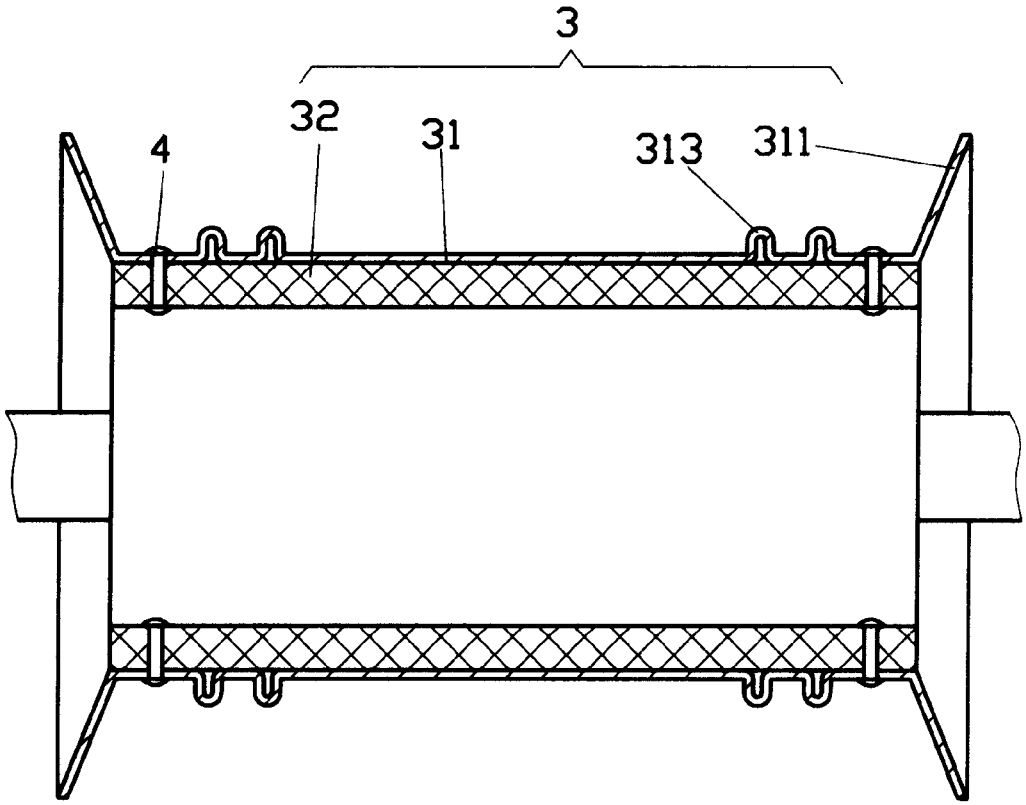
FIG. 4 is a cross sectional view of the pallet belt, shown in FIG. 4.
Figure 5:
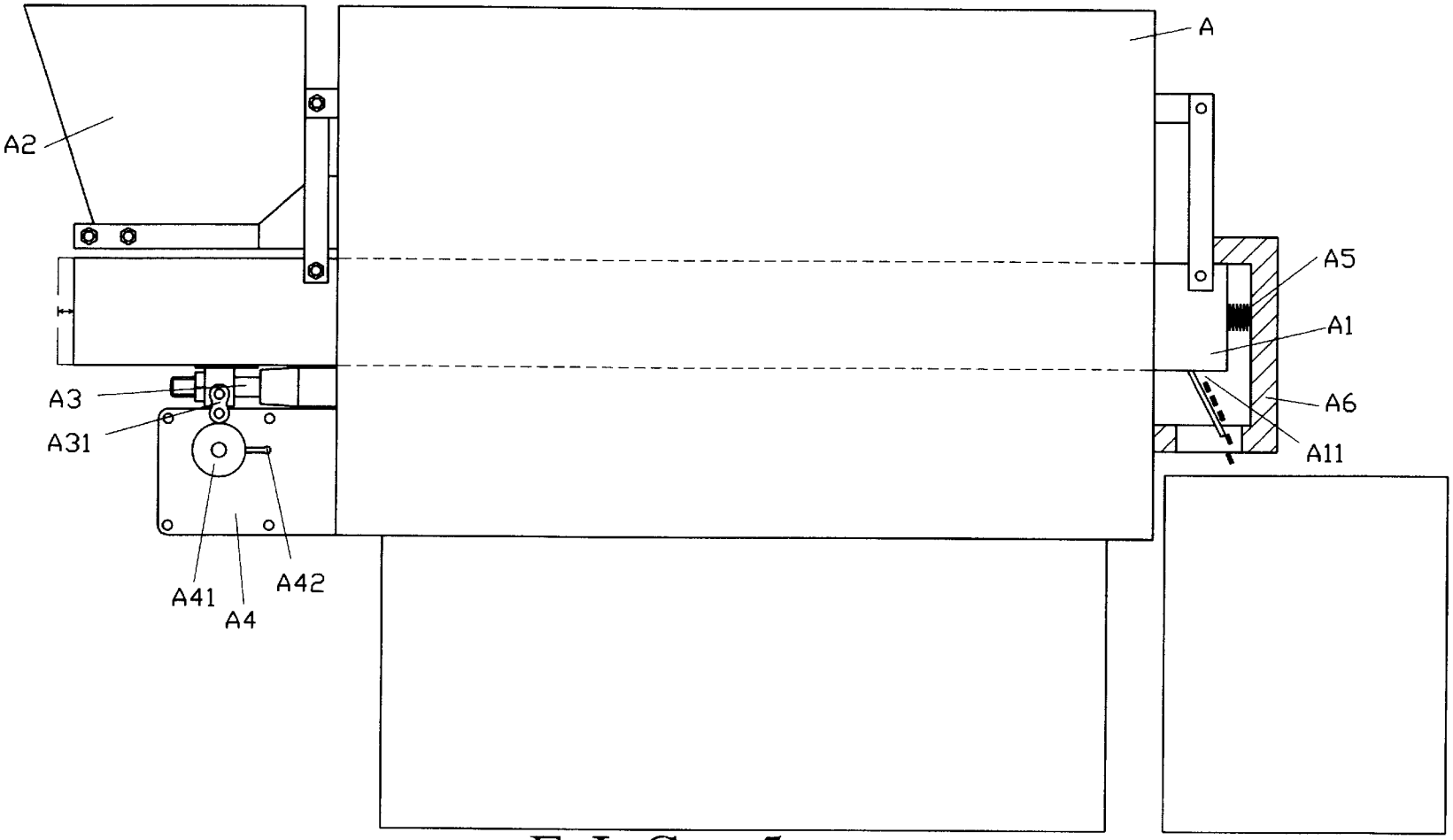
FIG. 5 (PRIOR ART)
FIGS. 5 and 6 are two prior arts.
Figure 6:
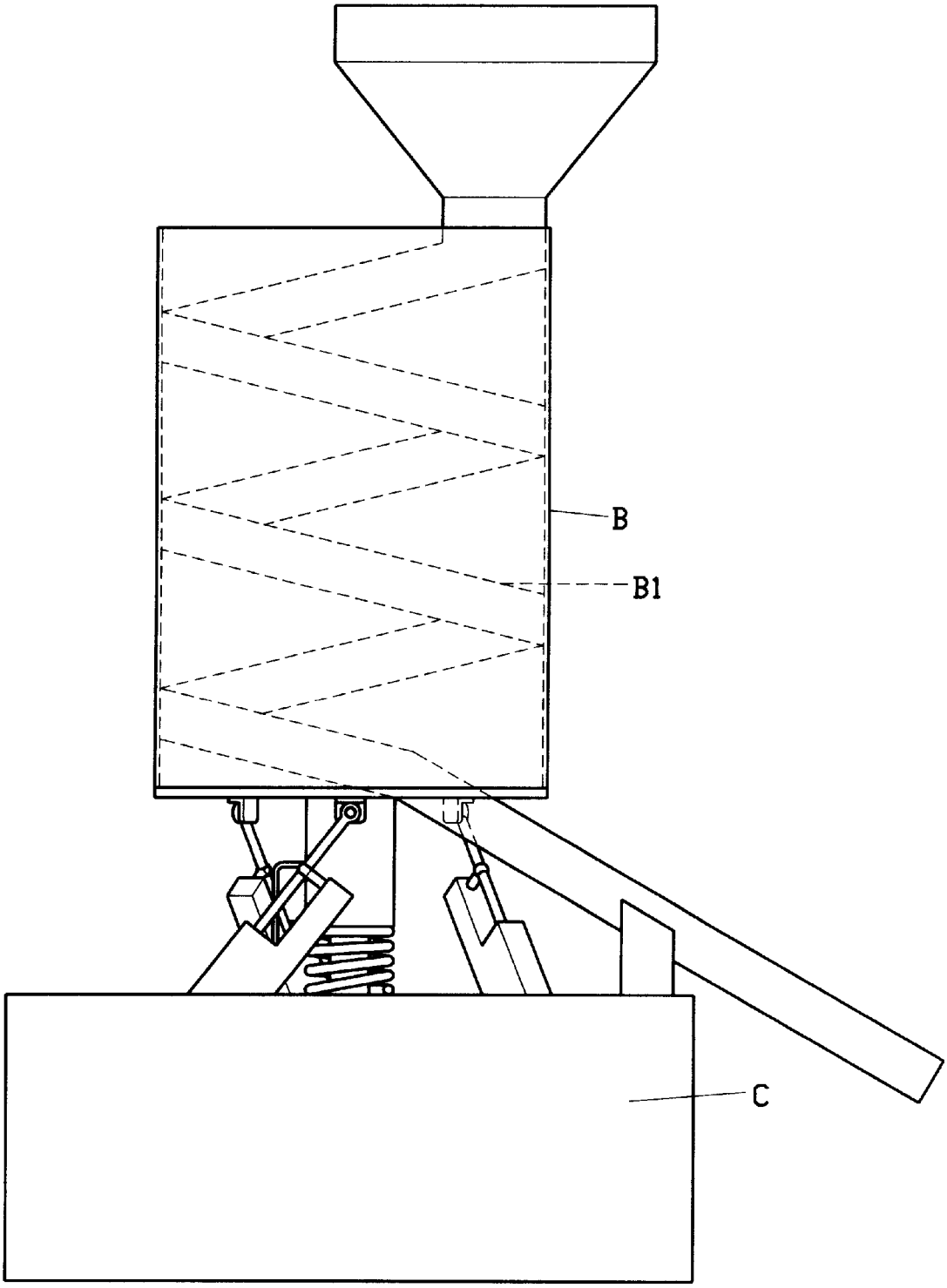
FIG. 6 (PRIOR ART)

Furthermore, the pallet belt 25 is a multi-layer design which is specifically designed for springs, elastic plates, etc., to prevent material from being hooked to the pallet belt during conveyance, and which may be in different types. As referring to FIGS. 3 and 4, the flat board 31 may be riveted to a net type belt 32, and the two sides of the board 31 are bent upwardly to form a guard rail 311 with a plural trough 312. A number of ribs 313 are on the two sides of the board 31 which confines material there within.

Further, the furnace 1 uses the isolating material 121 to form two sections can be done by just one section with the tempering process done outside of the furnace 1, and further, a flat furnace with isolating materials forming two sections is one of the invention scope.

I claim:

1. A heat treatment furnace and conveyor system, comprising:

a heating section surrounded by an isolating material;

a plurality of electric heating devices disposed in said heating section;

a plurality of first conveyors vertically spaced within said heating section in parallel relationship, each of said first conveyors longitudinally displacing a corresponding conveyor belt in a direction opposite an adjacent one of said plurality of first conveyors;

a feeder disposed at an upper portion of said furnace in open communication with said heating section for depositing material onto a first of said plurality of first conveyors;

a cooling section disposed below said heating section and being devoid of electric heating devices; and, a second conveyor disposed in said cooling section in parallel relationship with respect to said plurality of first conveyors, said second conveyor having a conveyor belt for receiving material from a lowermost one of said plurality of said first conveyors for displacement through said cooling section to a discharge opening, said conveyor belts of said plurality of first conveyors and said second conveyor each including:

(a) a plurality of longitudinally spaced stopper strips extending transversely across said conveyor belt; and, (b) a plurality of longitudinally extended ribs spaced longitudinally on each of two sides of said conveyor belt, said plurality of stopper strips and said plurality of ribs together defining a plurality of individual material receiving sections of said conveyor belt.

2. The heat treatment furnace and conveyor system as recited in claim 1 where each said conveyor belt is formed by multiple layers, an upper layer of said conveyor belt having a pair of upwardly directed side portions to form a pair of respective guide rail on each side of said conveyor belt and displaceable therewith.

* * * * *